US010753565B1

(12) United States Patent
Patel

(10) Patent No.: US 10,753,565 B1
(45) Date of Patent: Aug. 25, 2020

(54) VEHICULAR HEADLAMP REFLECTOR

(71) Applicant: True Parts, Inc., Bakersfield, CA (US)

(72) Inventor: Mitul Patel, Bakersfield, CA (US)

(73) Assignee: True Parts Inc., Bakersfield, CA (US)

( * ) Notice: Subject to any disclaimer, the term of this patent is extended or adjusted under 35 U.S.C. 154(b) by 0 days.

(21) Appl. No.: 16/706,311

(22) Filed: Dec. 6, 2019

(51) Int. Cl.

| | |
|---|---|
| ***F21V 7/00*** | (2006.01) |
| ***F21S 41/33*** | (2018.01) |
| ***F21S 41/145*** | (2018.01) |
| ***F21S 41/36*** | (2018.01) |
| ***F21S 41/148*** | (2018.01) |
| *F21Y 115/10* | (2016.01) |

(52) U.S. Cl.
CPC ..... *F21S 41/336* (2018.01); *F21S 41/145* (2018.01); *F21S 41/148* (2018.01); *F21S 41/36* (2018.01); *F21Y 2115/10* (2016.08)

(58) Field of Classification Search
CPC ..... F21S 41/336; F21S 41/145; F21S 41/36; F21S 41/148; F21Y 2115/10
USPC ..... 362/514, 516–518
See application file for complete search history.

(56) References Cited

U.S. PATENT DOCUMENTS

| | | | | |
|---|---|---|---|---|
| 4,481,563 | A * | 11/1984 | Snyder | F21S 41/335 362/518 |
| 4,704,661 | A * | 11/1987 | Kosmatka | F21S 41/336 362/518 |
| 5,171,082 | A | 12/1992 | Watanabe | |
| 7,192,164 | B2 | 3/2007 | Matsuura | |
| 7,347,599 | B2 * | 3/2008 | Minano | F21S 41/321 362/511 |
| 8,905,576 | B2 * | 12/2014 | Bolander, Jr. | G02B 19/0061 362/235 |
| 10,253,942 | B2 * | 4/2019 | Pfingstl | F21S 43/14 |
| 10,293,742 | B2 | 5/2019 | Fimeri et al. | |
| 10,330,276 | B2 | 6/2019 | Uchida et al. | |
| 10,393,336 | B2 | 8/2019 | Choi | |
| 2012/0147618 | A1 * | 6/2012 | Sato | F21S 41/321 362/517 |
| 2013/0242589 | A1 * | 9/2013 | Abe | F21S 41/32 362/512 |
| 2018/0187854 | A1 * | 7/2018 | Sato | F21S 41/151 |

* cited by examiner

*Primary Examiner* — Ali Alavi
(74) *Attorney, Agent, or Firm* — James M. Duncan; Scanlon Duncan LLP

(57) ABSTRACT

A parabolic reflector is utilized for a vehicle head lamp having a housing, lens, light emitting diodes and control circuits for the light emitting diodes. The parabolic reflector comprises a plurality of reflective panels in an upper array for the low beam and a lower array for the high beam. The upper array is formed by three rows of twelve panels in side-to-side configuration. The lower array is divide into two separate groups, with each group having a two outermost panels, two intermediate panels and two innermost panels. The reflective panels of the upper array and the lower array are so positioned with respect to the light emitting diodes as to form a desired luminous intensity distribution from the head lamp.

15 Claims, 5 Drawing Sheets

VEHICULAR HEADLAMP REFLECTOR

BACKGROUND OF THE INVENTION

The present invention generally relates to vehicle headlamps and more specifically to reflectors utilized with a light emitting diodes for the low beam and high beams for providing a desired luminous intensity distribution from the headlamp and forming an appropriate beam shape for particular motor vehicles. The present invention more specifically relates to a parabolic reflector of a vehicle headlamp wherein a plurality of reflecting elements or panels provides a desired luminous intensity distribution which is realized by each panel having a reflector panel angle, defined herein as the angle between a light beam from a light emitting diode traveling to a specific reflector panel and a beam reflected by the reflector panel.

SUMMARY OF THE INVENTION

Embodiments of the presently disclosed reflector are utilized with a vehicle light having housing, lens, light emitting diodes ("LEDs"), and control circuits for the LEDS. A low beam rod is attached to the housing, where the low beam rod has an LED chip mounted on its top. The vehicle light also has a high beam control circuit attached to the housing, where the high beam control circuit has separate LED chips connected to it. The reflector, having a parabolic cross-section is received within the housing with the lens attached to the front of the housing. The LED chips of the low beam rod and the high beam control circuit are disposed between the reflector and the lens. The reflector of the present invention utilizes an upper array of low beam reflector panels and a lower array of high beam reflector panels.

An embodiment of the reflector of the present invention may have an upper array having a top row, middle row and bottom row, where each row comprises twelve panels in side-to-side configuration. A low beam reflector panel angle is defined as the angle between a light beam from the LED chip of the low beam rod traveling to a reflector panel and a beam reflected by the reflector panel of the upper array. This embodiment may further have a lower array of high beam reflector panels, where the lower array comprises two outermost panels, two innermost panels, and two intermediate panels. A high beam reflector panel angle is defined as the angle between a light beam from the LED chip of the high beam control circuit traveling to a reflector panel of the lower array and a beam reflected by the reflector panel of the lower array. In some embodiments, all of the high beam reflector panels may have the same high beam reflector panel angle. In some embodiments, the high beam reflector panel angle may be 87 degrees.

In some embodiments the reflector panel angles for the top row may be, in side-to-side sequence, 19 degrees, 30 degrees, 41 degrees, 45 degrees, 47 degrees, 49 degrees, 47 degrees, 45 degrees, 41 degrees, 30 degrees and 19 degrees.

The reflector panel angles for the middle row may be, in side-to-side sequence, 15 degrees, 15 degrees, 20 degrees, 20 degrees, 60 degrees, 60 degrees, 60 degrees, 60 degrees, 20 degrees, 20 degrees, 15 degrees and 15 degrees.

The reflector panel angles for the bottom row may be, in side-to-side sequence, 29 degrees, 45 degrees, 48 degrees, 61 degrees, 72 degrees, 72 degrees, 72 degrees, 72 degrees, 61 degrees, 48 degrees, 45 degrees and 29 degrees.

DETAILED DESCRIPTION OF THE INVENTION

Figure 1:
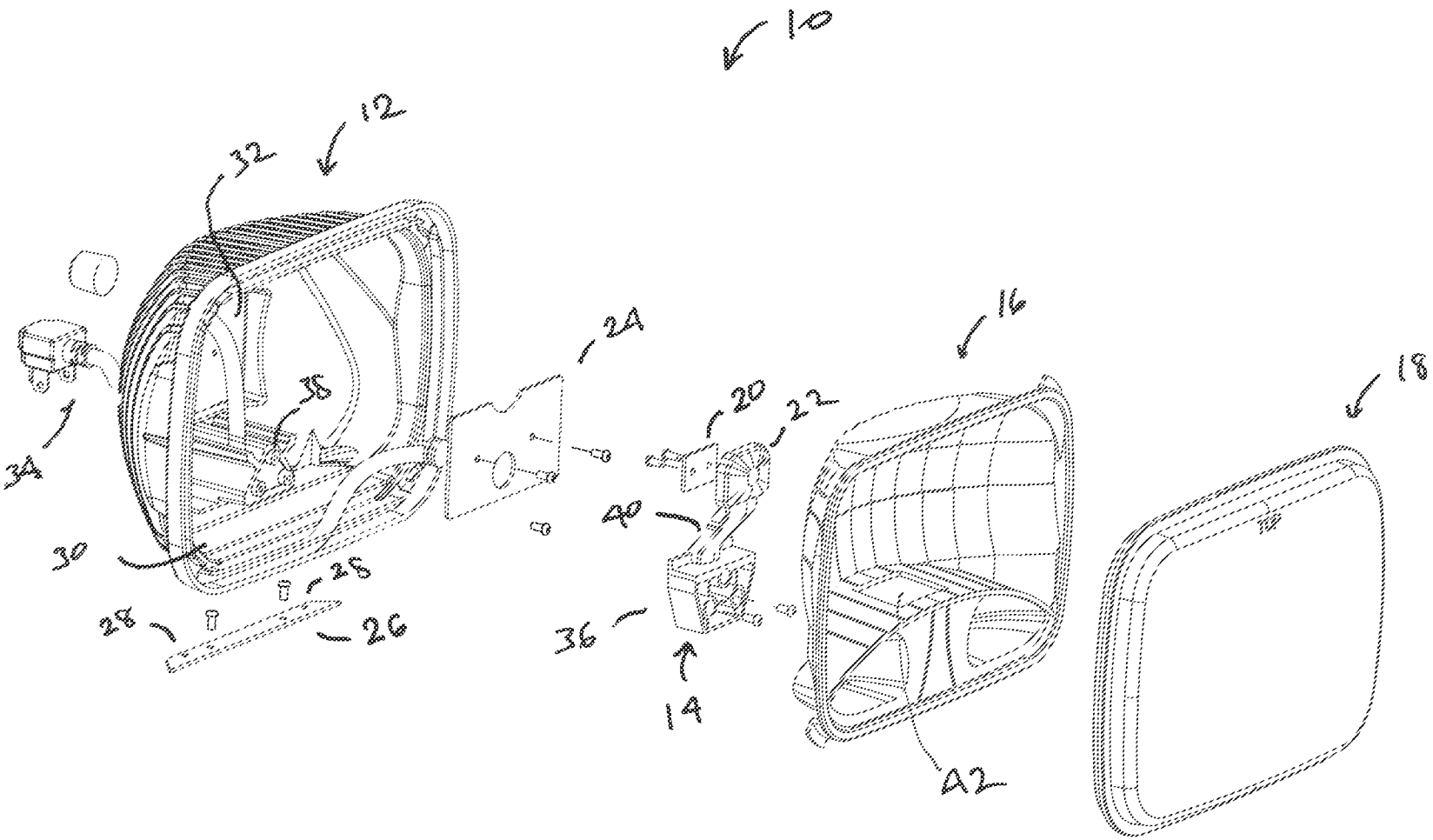
FIG. 1 shows an exploded right side frontal view of the headlamp.
Figure 2:
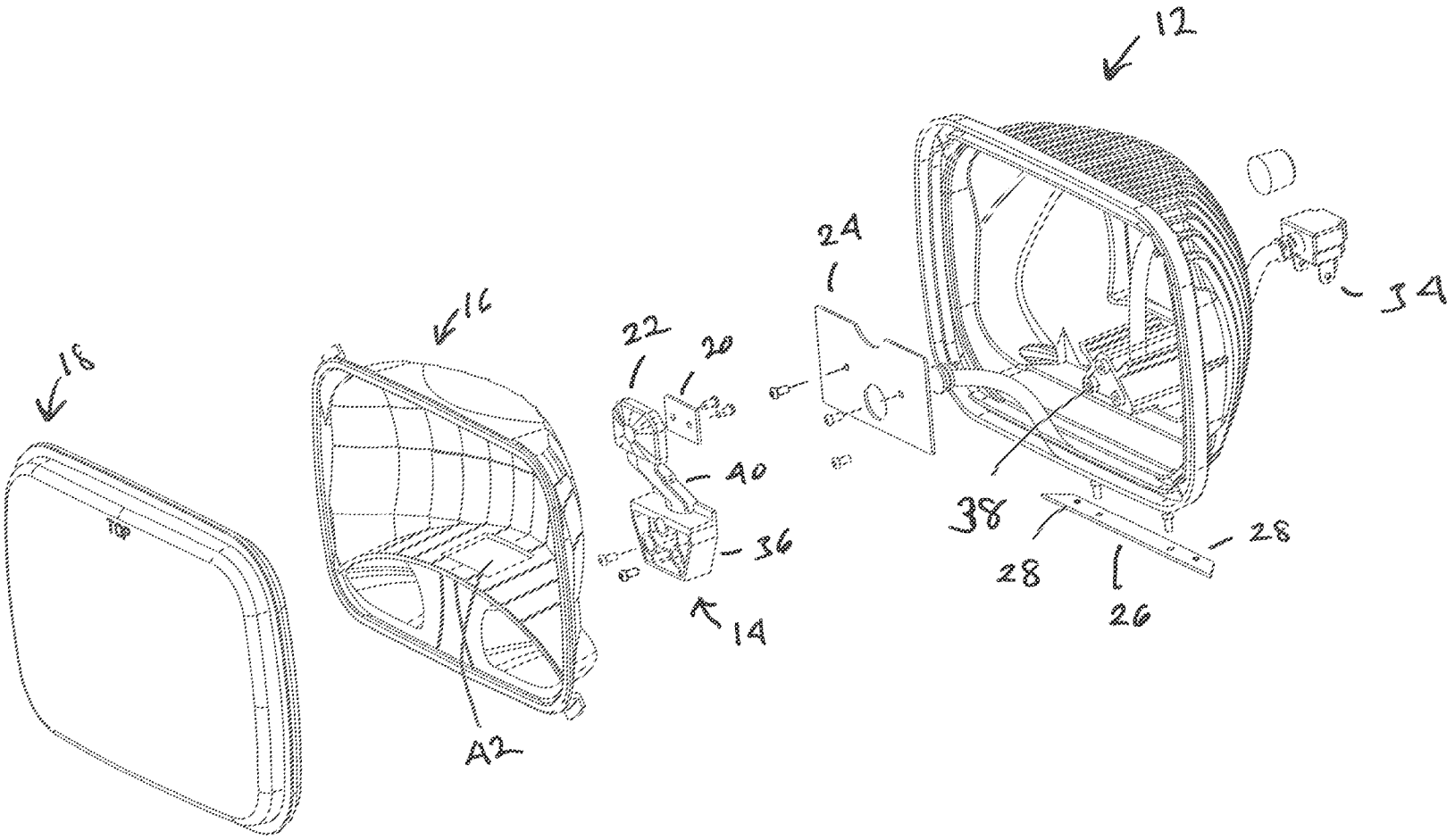
FIG. 2 shows an exploded left side frontal view of the headlamp.
Figure 3:
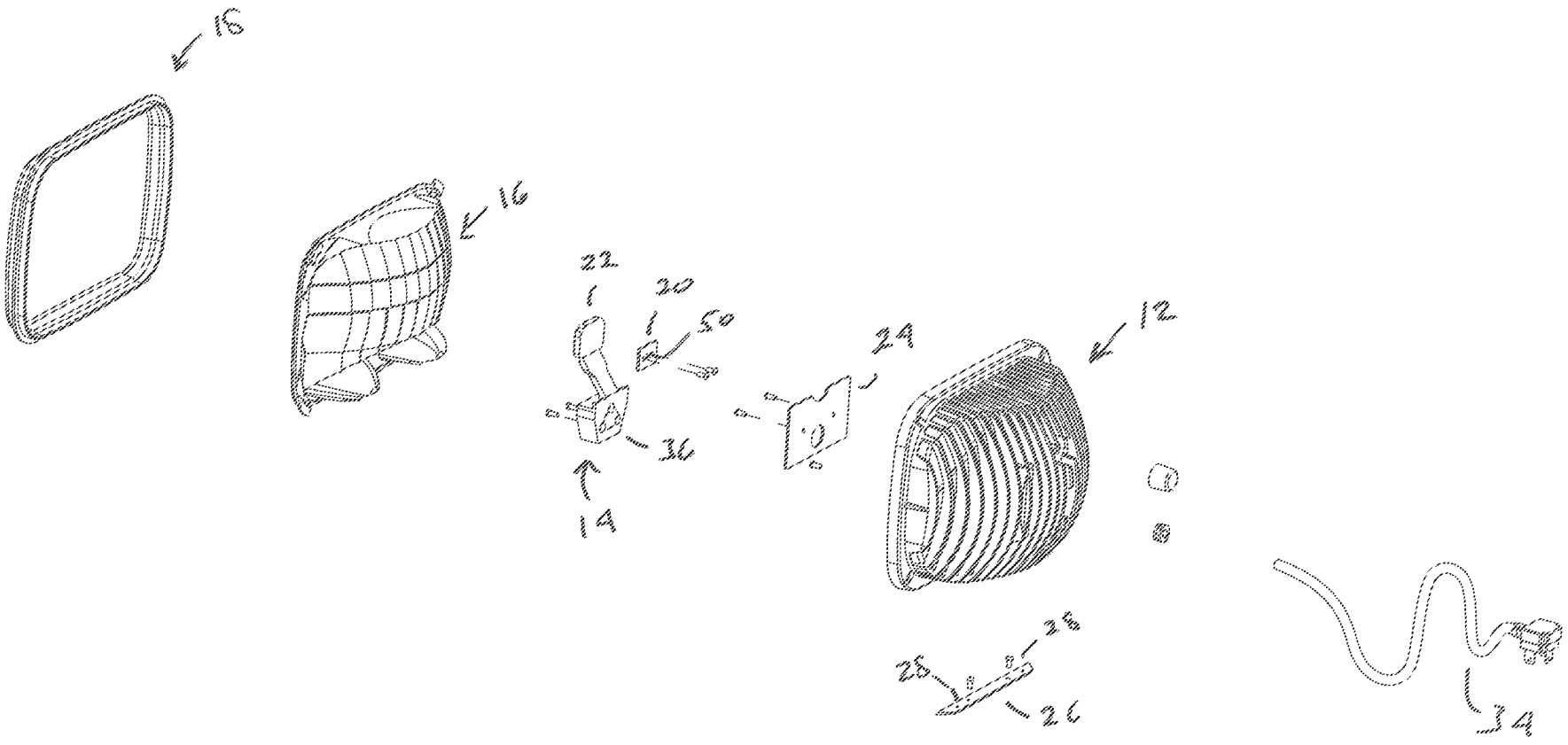
FIG. 3 shows an exploded left side rear view of the headlamp.

Referring now to the figures, an embodiment of a headlamp 10 is depicted in FIGS. 1-3, where the headlamp comprises a housing 12, a low beam light assembly 14, a parabolic reflector 16, and a clear lens 18. A printed circuit board 20 has a low beam control circuit which controls an LED chip 50 which is attached to the rear of LED mount 22 of low beam light assembly 14. Printed circuit board 20 conductively connects to a driver panel 24 which mounts within housing 12. A high beam printed circuit board 26, which is also conductively connected to driver panel 24, has LED chips 28.

Figure 5:
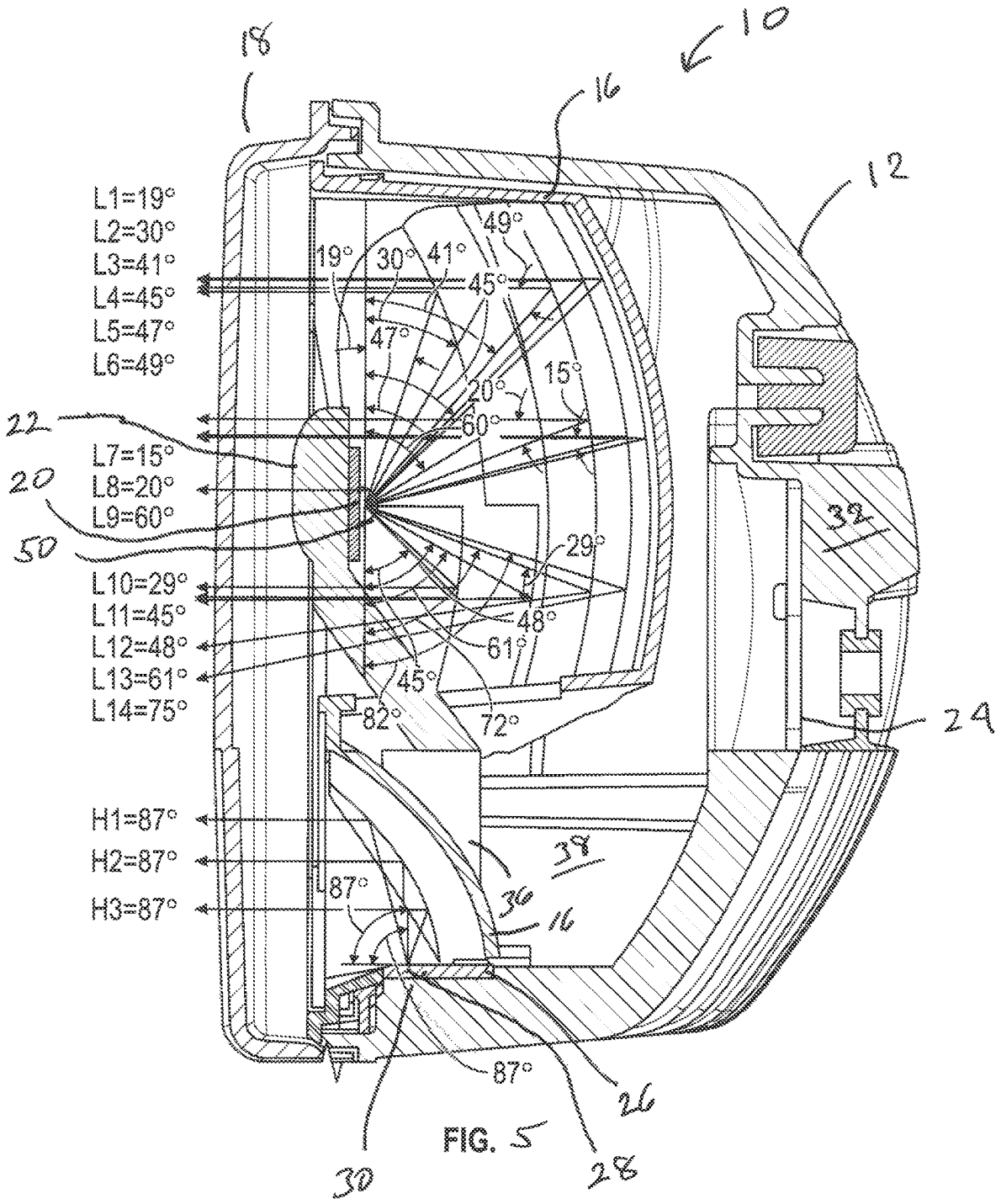
FIG. 5 is a sectional view taken along section 2-2 of FIG. 1, showing the reflector panel angles for each of the panels.

High beam printed circuit board 26 mounts to a shelf structure 30 in housing 12, while driver panel 20 is attaches to rear panel 32 of the housing 12. A plug assembly 34 provides a current at low voltage (6-12 volts) to driver panel 24. As shown in FIG. 5, LED chips 28 are positioned facing upwards directing a beam at the lower panels on each side of the parabolic reflector 16.

Low beam light assembly 14 has a pedestal member 36 which attaches to attachment block 38 of housing 12. Low beam light assembly 14 has a rod member 40 upon which the LED mount 22 is mounted. LED housing 22 penetrates through parabolic reflector 16 at opening 42, such that the LED housing 22 is disposed between the upper array of panel members L1 through L14 of parabolic reflector 16 to the rear and clear lens 18 to the front, where the LED chip 50 directs light beams back to the panels L1 through L14 of parabolic reflector 16.

Figure 4:
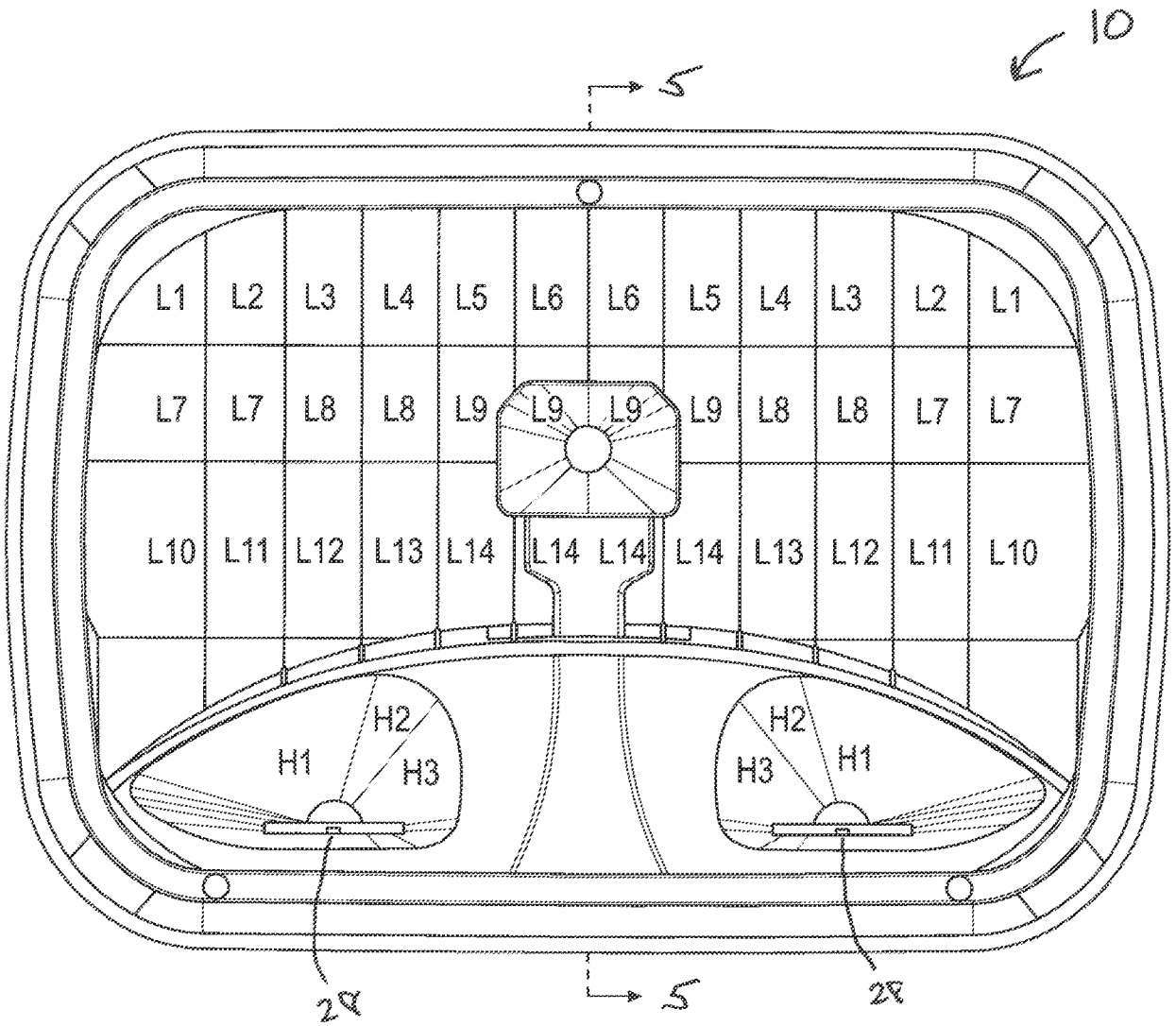
FIG. 4 depicts a front view of a headlamp, showing the designations for each of the panels of the reflector.

Parabolic reflector 16 comprises an upper array of low beam panel members comprising a top row, a middle row, and a bottom row, where each row comprises 12 panels in side-to-side configuration. As shown in FIG. 4, the top row comprises panel members L1 through L6, progressing from L1 at the outside edge to L6 at middle of the row, and then members L6 through L1 progressing to the opposite side of the parabolic reflector 16. The middle row comprises two panel members L7 on each end, two panel members L8 at intermediate positions each side of the row, and four panel members L9 at the center of the row. The bottom row comprises panel members L10 through L14, progressing from L10 at the outside edge progressing to four panel member 114 at the center of the row, and then, progressing toward the opposite end of the parabolic reflector 16 members L13 through L10.

LED chip 50 has a central light emitting axis. The LED chip 50 is positioned relative to the reflecting surfaces of panel members L1 through L14 such that the central light emitting axis is angled at a predetermined angle with respect to each reflective surface. In other words, panel members L1 through L14 are so positioned with respect to LED chip 50 that the central light emitting axis from the LED chip is reflected by a predetermined angle from each low beam reflector panel member forming a reflected beam towards clear lens 18. The angle between the central light emitting axis and the reflected beam is defined herein as the low beam reflector panel angle. For embodiments of the present reflector, the low beam reflector panel angels for panel members L1 through L14 are, respectively, 19 degrees, 30 degrees, 41 degrees, 45 degrees, 47 degrees, 49 degrees, 15 degrees, 20 degrees, 60 degrees, 29 degrees, 45 degrees, 48 degrees, 61 degrees and 75 degrees.

Parabolic reflector 16 has two lower array of panel members comprising two outermost panels H1, two intermediate panels H2, and two innermost panels H3. Panel members H1 through H3 are so positioned with respect to LED chips 28 that the central light emitting axis from each LED chip to the high beam panel members H1 through H3 is reflected by the high beam panel members forming a reflected beam towards clear lens 18. The angle between the central light emitting axis from LED chips 28 and the reflected beam from the high beam panel members is defined herein as the high beam reflector panel angle. For the embodiment of the reflector depicted in FIGS. 4-5, the high beam reflector panel angles for panel members H1 through H3 are identical.

Having thus described the preferred embodiment of the invention, what is claimed as new and desired to be protected by Letters Patent includes the following:

1. In a vehicle light comprising a housing, a low beam rod having a first LED chip mounted on the top of the low beam rod, the low beam rod attached to the housing, a low beam control circuit connected to the first LED chip, a second LED chip connected to a high beam control circuit, the high beam control circuit attached to the housing, the vehicle light further comprising a lens and a reflector comprising a parabolic cross-section attached to the housing, wherein the first LED chip and the second LED chip are disposed between the reflector and the lens, wherein the reflector comprises:

an upper array of low beam reflector panels, the upper array having a top row, a middle row and a bottom row, wherein the top row comprises twelve top row panels in side-to-side configuration, the middle row comprising twelve middle row panels in side-to-side configuration, and the bottom row comprises twelve bottom row panels in side-to-side configuration, wherein a low beam reflector panel angle is defined as the angle between a light beam from the first LED chip traveling to a reflector panel of the upper array and a beam reflected by the reflector panel of the upper array; and a lower array of high beam reflector panels, the lower array comprising two outermost panels, two innermost panels, and two intermediate panels, wherein a high beam reflector panel angle is defined as the angle between a light beam from the second LED chip traveling to a reflector panel of the lower array and a beam reflected by the reflector panel of the lower array.

2. The vehicle light of claim 1 wherein the two outermost panels, the two innermost panels and the two intermediate panels have the same high beam reflector panel angle.

3. The vehicle light of claim 2 wherein the high beam reflector panel angle is 87 degrees.

4. The vehicle light of claim 1 wherein the reflector panel angles for the top row are, in sequence, from side-to-side of the top row: 19 degrees, 30 degrees, 41 degrees, 45 degrees, 47 degrees, 49 degrees, 47 degrees, 45 degrees, 41 degrees, 30 degrees and 19 degrees;

wherein the reflector panel angles for the middle row are, in sequence, from side-to-side of the middle row: 15 degrees, 15 degrees, 20 degrees, 20 degrees, 60 degrees, 60 degrees, 60 degrees, 60 degrees, 20 degrees 20 degrees, 15 degrees and 15 degrees; and wherein the reflector panel angles for the bottom row are, in sequence from side-to-side of the bottom row: 29 degrees, 45 degrees, 48 degrees, 61 degrees, 72 degrees, 72 degrees, 72 degrees, 72 degrees, 61 degrees, 48 degrees, 45 degrees, and 29 degrees.

5. In a vehicle light comprising a housing, a low beam rod having a first LED chip mounted on the top of the low beam rod, the low beam rod attached to the housing, a low beam control circuit connected to the first LED chip, a second LED chip connected to a high beam control circuit, the high beam control circuit attached to the housing, the vehicle light further comprising a lens and a reflector comprising a parabolic cross-section attached to the housing, wherein the first LED chip and the second LED chip are disposed between the reflector and the lens, wherein the reflector comprises:

an upper array of low beam reflector panels, the upper array having a top row, a middle row and a bottom row, the top row comprising twelve top row panels in side-to-side configuration, the middle row comprising twelve middle row panels in side-to-side configuration, and the bottom row comprising twelve bottom row panels in side-to-side configuration, wherein a reflector panel angle is defined as the angle between a light beam from the first LED chip traveling to a reflector panel and a light beam reflected from the reflector panel;

wherein the reflector panel angles for the top row are, in sequence, from side-to-side of the top row: 19 degrees, 30 degrees, 41 degrees, 45 degrees, 47 degrees, 49 degrees, 47 degrees, 45 degrees, 41 degrees, 30 degrees and 19 degrees;

wherein the reflector panel angles for the middle row are, in sequence, from side-to-side of the middle row: 15 degrees, 15 degrees, 20 degrees, 20 degrees, 60 degrees, 60 degrees, 60 degrees, 60 degrees, 20 degrees 20 degrees, 15 degrees and 15 degrees; and wherein the reflector panel angles for the bottom row are, in sequence from side-to-side of the bottom row: 29 degrees, 45 degrees, 48 degrees, 61 degrees, 72 degrees, 72 degrees, 72 degrees, 72 degrees, 61 degrees, 48 degrees, 45 degrees, and 29 degrees.

6. The vehicle light of claim 5 further comprising a lower array of high beam reflector panels, the lower array comprising two outermost panels, two innermost panels, and two intermediate panels, wherein a high beam reflector panel angle is defined as the angle between a light beam from the second LED chip traveling to a reflector panel of the lower array.

7. The vehicle light of claim 6 wherein the two outermost panels, the two innermost panels and the two intermediate panels have the same high beam reflector panel angle.

8. The vehicle light of claim 7 where the high beam reflector panel angle is 87 degrees.

9. In a vehicle light comprising a housing, a low beam rod having a first LED chip mounted on the top of the low beam rod, the low beam rod attached to the housing, a low beam control circuit connected to the first LED chip, a second LED chip connected to a high beam control circuit, the high beam control circuit attached to the housing, the vehicle light further comprising a lens and a reflector comprising a parabolic cross-section attached to the housing, wherein the first LED chip and the second LED chip are disposed between the reflector and the lens, wherein the reflector comprises:

an upper array of low beam reflector panels, the upper array having a top row, a middle row and a bottom row, wherein a low beam reflector panel angle is defined as the angle between a light beam from the first LED chip traveling to a reflector panel of the upper array and a beam reflected by the reflector panel of the upper array; and wherein the top row comprises twelve top row panels in side-to-side configuration comprising two top row outermost panels, two top row innermost panels, a first top row intermediate outer panel immediately adjacent to each of the top row outermost panels, a second top row intermediate outer panel immediately adjacent to each of the first top row intermediate panels, a first top row intermediate inner panel immediately adjacent to each of the top row innermost panels, and a second top row intermediate inner panel immediately adjacent to each of the first top row intermediate inner panels, wherein the two top row outermost panels have the same low beam reflector panel angle, the two top row innermost panels have the same low beam reflector panel angle, the first top row intermediate outer panels have the same low beam reflector panel angle, the second top row intermediate outer panels have the same low beam reflector panel angle, the first top row intermediate inner panels have the same low beam reflector panel angle, and the second top row intermediate inner panels have the same low beam reflector panel angle;

wherein the middle row comprises twelve middle row panels in side-to-side configuration comprising two middle row outermost panels, two middle row innermost panels, a first middle row intermediate outer panel immediately adjacent to each of the middle row outermost panels, a second middle row intermediate outer panel immediately adjacent to each of the first middle row intermediate panels, a first middle row intermediate inner panel immediately adjacent to each of the middle row innermost panels, and a second middle row intermediate inner panel immediately adjacent to each of the first middle row intermediate inner panels, wherein the two middle row outermost panels and the first middle row intermediate outer panels have the same low beam reflector panel angle, the two middle row innermost panels and the first middle row intermediate inner panels have the same low beam reflector panel angle, and the second middle row intermediate outer panels and the second middle row intermediate inner panels have the same low beam reflector panel angles; and wherein the bottom row comprises twelve bottom row panels in side-to-side configuration comprising two bottom row outermost panels, two bottom row innermost panels, a first bottom row intermediate outer panel immediately adjacent to each of the bottom row outermost panels, a second bottom row intermediate outer panel immediately adjacent to each of the first bottom row intermediate panels, a first bottom row intermediate inner panel immediately adjacent to each of the bottom row innermost panels, and a second bottom row intermediate inner panel immediately adjacent to each of the first bottom row intermediate inner panels, wherein the two bottom row outermost panels have the same low beam reflector panel angle, the two bottom row innermost panels have the same low beam reflector panel angle, the first bottom row intermediate outer panels have the same low beam reflector panel angle, the second bottom row intermediate outer panels have the same low beam reflector panel angle, the first bottom row intermediate inner panels have the same low beam reflector panel angle as the bottom row innermost panels, and the second bottom row intermediate inner panels have the same low beam reflector panel angle.

10. The vehicle light of claim 9 further comprising a lower array of high beam reflector panels, the lower array comprising two outermost panels, two innermost panels, and two intermediate panels, wherein a high beam reflector panel angle is defined as the angle between a light beam from the second LED chip traveling to a reflector panel of the lower array and a beam reflected by the reflector panel of the lower array.

11. The vehicle light of claim 10 wherein the two outermost panels, the two innermost panels and the two intermediate panels have the same high beam reflector panel angle.

12. The vehicle light of claim 11 wherein the high beam reflector panel angle is 87 degrees.

13. The vehicle light of claim 9 wherein the two top row outermost panels have a low beam reflector panel angle of 19 degrees, the two top row innermost panels have a low beam reflector angle of 49 degrees, the first top row intermediate outer panels have a low beam reflector angle of 30 degrees, the second top row intermediate outer panels have a low beam reflector angle of 41 degrees, the first top row intermediate inner panels have a low beam reflector angle of 47 degrees, and the second top row intermediate inner panels have a low beam reflector angle of 45 degrees.

14. The vehicle light of claim 9 wherein the two middle row outermost panels have a low beam reflector panel angle of 15 degrees, the two middle row innermost panels have a low beam reflector panel angle of 60 degrees, the first middle row intermediate outer panels have a low beam reflector angle of 15 degrees, the second middle row intermediate outer panels have a low beam reflector angle of 20 degrees, the first middle row intermediate inner panels have a low beam reflector angle of 60 degrees, and the second middle row intermediate inner panels have a low beam reflector angle of 20 degrees.

15. The vehicle light of claim 9 wherein the two bottom row outermost panels have a low beam reflector angle of 29 degrees, the two bottom row innermost panels have a low beam reflector angle of 72 degrees, the first bottom row intermediate outer panels have a low beam reflector angle of 45 degrees, the second bottom row intermediate outer panels have a low beam reflector angle of 48 degrees, the first bottom row intermediate inner panels have a low beam reflector angle of 72 degrees, and the second bottom row intermediate inner panels have a low beam reflector angle of 61 degrees.

* * * * *